US006848280B1

(12) United States Patent
Honeycutt

(10) Patent No.: US 6,848,280 B1
(45) Date of Patent: Feb. 1, 2005

(54) CIRCULAR KNITTING MACHINE

(76) Inventor: Larry W. Honeycutt, P.O. Box 86, Concord, NC (US) 27026

( * ) Notice: Subject to any disclaimer, the term of this patent is extended or adjusted under 35 U.S.C. 154(b) by 359 days.

(21) Appl. No.: 10/120,851

(22) Filed: Apr. 11, 2002

(51) Int. Cl.[7] ..... D04B 9/40
(52) U.S. Cl. ..... 66/148
(58) Field of Search ..... 66/147, 148, 149 R, 66/150, 151, 152, 153, 149 S; 112/470.33, 470.31, 470.32, 136, 147–153

(56) References Cited

U.S. PATENT DOCUMENTS

| | | | | | |
|---|---|---|---|---|---|
| 3,550,402 | A | | 12/1970 | Colton | 66/147 |
| 3,738,123 | A | | 6/1973 | Mazzi | 66/149 |
| 3,745,794 | A | | 7/1973 | Brackett et al. | 66/149 |
| 3,926,015 | A | | 12/1975 | Sangiacomo | 66/147 |
| 4,009,672 | A | * | 3/1977 | Rockerath et al. | 112/475.06 |
| 4,069,090 | A | | 1/1978 | Boyer | 156/498 |
| 4,102,727 | A | | 7/1978 | Bell | 156/251 |
| 4,111,138 | A | * | 9/1978 | Rockerath et al. | 112/141 |
| 4,157,651 | A | | 6/1979 | Coggins et al. | 6/147 |
| 4,236,472 | A | * | 12/1980 | Rockerath et al. | 112/304 |
| 4,250,723 | A | | 2/1981 | Harrill | 66/147 |
| 4,454,730 | A | | 6/1984 | Gregory et al. | 66/149 |
| 4,773,237 | A | | 9/1988 | Lonati | 66/149 |
| 5,417,089 | A | | 5/1995 | Honeycutt | 66/147 |
| 5,606,876 | A | * | 3/1997 | Sangiacomo | 66/148 |
| 5,931,024 | A | | 8/1999 | Honeycutt | 66/147 |
| 6,389,849 | B1 | * | 5/2002 | Conti | 66/148 |
| 6,665,578 | B2 | * | 12/2003 | Ochi et al. | 66/148 |

* cited by examiner

*Primary Examiner*—Danny Worrell
(74) *Attorney, Agent, or Firm*—MacCord Mason PLLC

(57) ABSTRACT

A circular knitting machine for producing a tubular knitted article having a closed end is disclosed. The apparatus includes a knitting cylinder for forming the tubular knitted material; an accumulator downstream of the knitting cylinder for permitting the knitting cylinder to continuously form the tubular knitted material; and a stitching closure assembly downstream from the accumulator. The stitching closure assembly includes a sewing head, a fabric positioner, a conduit for connecting the fabric positioner to the accumulator and a fabric guide. Further, the circular knitting machine may include a fabric control system for selectively actuating the sewing head, the fabric positioner and the fabric guide for automatically producing the tubular knitted article having a closed end.

30 Claims, 10 Drawing Sheets

CIRCULAR KNITTING MACHINE

BACKGROUND OF THE INVENTION (1) Field of the Invention

The present invention relates generally to circular knitting machines and, more particularly, to a circular knitting machine for producing a tubular knitted article having a closed end, such as a "socky" worn by a woman customer trying on new shoes.

(2) Description of the Prior Art

In the production of circular-knit hosiery, one end of a knitted tubular article is closed to form the toe. Traditional methods for closing the end of a tubular fabric include difficult and expensive operations. These operations are usually performed separately from the knitting operations, are relatively costly, and result in lower productivity.

One prior art solution was to close the end of the tubular fabric while it is still on a circular knitting machine. More specifically, hot knife cutting and fusion is disclosed in U.S. Pat. No. 4,069,090. However, a heated tool used for cutting and fusion produces build-up on the tool face, which requires regular cleaning, and therefore machine down-time, in order to ensure consistent fabric closure and sealing.

Another prior art solution was to incorporate an end closure apparatus which used a hot air nozzle to close the tubular knit fabric ends, as disclosed in U.S. Pat. No. 5,417,089, which is hereby incorporated by reference, in its entirety. However, the end closure apparatus required machine operation cycle interruption, thus reducing productivity by increasing machine cycle time. Additionally, no means for automatically detecting and controlling fabric length and activating the end closure apparatus accordingly is disclosed; fabric tension cannot be maintained while the end closure apparatus is activated. Therefore, the circular knitting machine operating cycle is necessarily interrupted by activation of the end closure apparatus.

Further, the prior art describes a vacuum operated tensioning device to maintain tension on the tubular fabric during the fabric cutting and closure functions. For example, U.S. Pat. No. 3,738,123, which is hereby incorporated by reference in its entirety, discloses a tensioning device for circular knitting machines including a control valve which enables suction to be applied selectively and alternately to a discharge conduit and a perforate duct to control fabric tension during machine operation. No cutting or end closure means is disclosed or suggested by this reference.

Problems associated with prior art methods of closing the end of the tubular fabric while it is still on a circular knitting machine include interrupting the machine operating cycle to perform the closure, unreliable closure of the tubular knit article, and manual operation or cleaning of the closure-forming element. These problems contribute to lower product quality, higher cycle times, and higher costs.

One prior art solution to the above problem of designing a practical circular knitting machine for producing a tubular knitted article having a closed end is disclosed in U.S. Pat. No. 5,931,024, which is hereby incorporated by reference, in its entirety. This apparatus includes a circular knitting element for forming the tubular knitted article and a closure assembly located downstream of the circular knitting element for forming the closed end. An accumulator assembly is located between the circular knitting element and the closure assembly to provide tension to the tubular knitted article when the closure assembly is closed, thereby permitting the circular knitting element to continuously form the tubular knitted article during the operation of the closure assembly. Also, in the preferred embodiment, a cutting assembly is located between the accumulator assembly and the closure assembly, the cutting assembly being selectively operable to cut the tubular knitted article during the operation of the closure assembly. However, because thermal fusing is utilized, only materials using thermoplastic or thermosetting resins can be formed. Other desirable materials such as cotton can not be closed in this manner.

Thus, there remains a need for a new and improved circular knitting machine for automatically producing a tubular article, formed from a variety of natural and synthetic materials, having a closed end, without interrupting the machine operating cycle, thereby providing significant increases in production.

SUMMARY OF THE INVENTION

The present invention is directed to a circular knitting machine for producing a tubular knitted article having a closed end. The apparatus includes a knitting cylinder for forming the tubular knitted material; an accumulator downstream of the knitting cylinder for permitting the knitting cylinder to continuously form the tubular knitted material; and a stitching closure assembly downstream from the accumulator. The stitching closure assembly includes a sewing head, a fabric positioner, a conduit for connecting the fabric A positioner to the accumulator and a fabric guide.

In the preferred embodiment, the fabric positioner is a transfer box having a sealed enclosure, a rotary transfer tube, and an actuator for rotating the rotary transfer tube to present fabric to the sewing head. The transfer tube preferably includes a coupling to connect the transfer tube to the conduit and a fabric access port. Also, in the preferred embodiment, the fabric access port includes an elongated slot formed from a quarter segment of the tube. A fabric feeder, such as an air jet, may be used to help in presenting the fabric to the sewing head.

In the preferred embodiment, the fabric guide includes: a frame positioned adjacent to the sewing head; a continuous belt attached to the frame; and a motor for rotating the belt, whereby the fabric guide maintains tension on the fabric for presentment to the sewing head as the fabric is sewn and cut. Preferably, the frame includes a support plate, a plurality of guide rollers for the belt and a cover plate. The motor may further include a speed control. Also, the fabric guide may further include belt tensioners and belt length adjusters.

In the preferred embodiment, the apparatus further includes a fabric control system selectively actuates the sewing head, the fabric positioner and the fabric guide for automatically producing the tubular knitted article having a closed end. The control system includes a fabric clamp on the stitch side of the sewing head and a controller for selectively activating the fabric clamp. In the preferred embodiment, the fabric clamp is a Buno valve. The fabric control system further includes a fabric tensioner on the knife-side of the sewing head. In the preferred embodiment, the fabric tensioner includes an air amplifier. The fabric control system further includes a fabric length sensor for detecting the position of the knitted article and initiating a new sewing cycle.

Accordingly, one aspect of the present invention is to provide a circular knitting machine for producing a tubular knitted article having a closed end. The apparatus includes: a knitting cylinder for forming the tubular knitted material; an accumulator downstream of the knitting cylinder, the accumulator being selectively operable to permit the knitting cylinder to continuously form the tubular knitted material; and a stitching closure assembly downstream from the accumulator including a sewing head, a fabric positioner and a conduit for connecting the fabric positioner to the accumulator.

Another aspect of the present invention is to provide a fabric guide for a stitching closure assembly including a sewing head for sewing a length of fabric. The fabric guide includes: a frame positioned adjacent to the sewing head; a continuous belt attached to the frame; and a motor for rotating the belt, whereby the fabric guide maintains tension on the fabric for presentment to the sewing head as the fabric is sewn and cut.

Still another aspect of the present invention is to provide a circular knitting machine for producing a tubular knitted article having a closed end. The apparatus includes: a knitting cylinder for forming the tubular knitted material; an accumulator downstream of the knitting cylinder, the accumulator being selectively operable to permit the knitting cylinder to continuously form the tubular knitted material; a stitching closure assembly downstream from the accumulator including a sewing head, a fabric positioner, a conduit for connecting the fabric positioner to the accumulator and a fabric guide, the fabric guide including: (i) a frame positioned adjacent to the sewing head; (ii) a continuous belt attached to the frame; and (iii) a motor for rotating the belt, whereby the fabric guide maintains tension on the fabric for presentment to the sewing head as the fabric is sewn and cut; and a fabric control system for selectively actuating the sewing head, the fabric positioner and the fabric guide for automatically producing the tubular knitted article having a closed end.

These and other aspects of the present invention will become apparent to those skilled in the art after a reading of the following description of the preferred embodiment when considered with the drawings.

DESCRIPTION OF THE PREFERRED EMBODIMENTS

Figure 1:
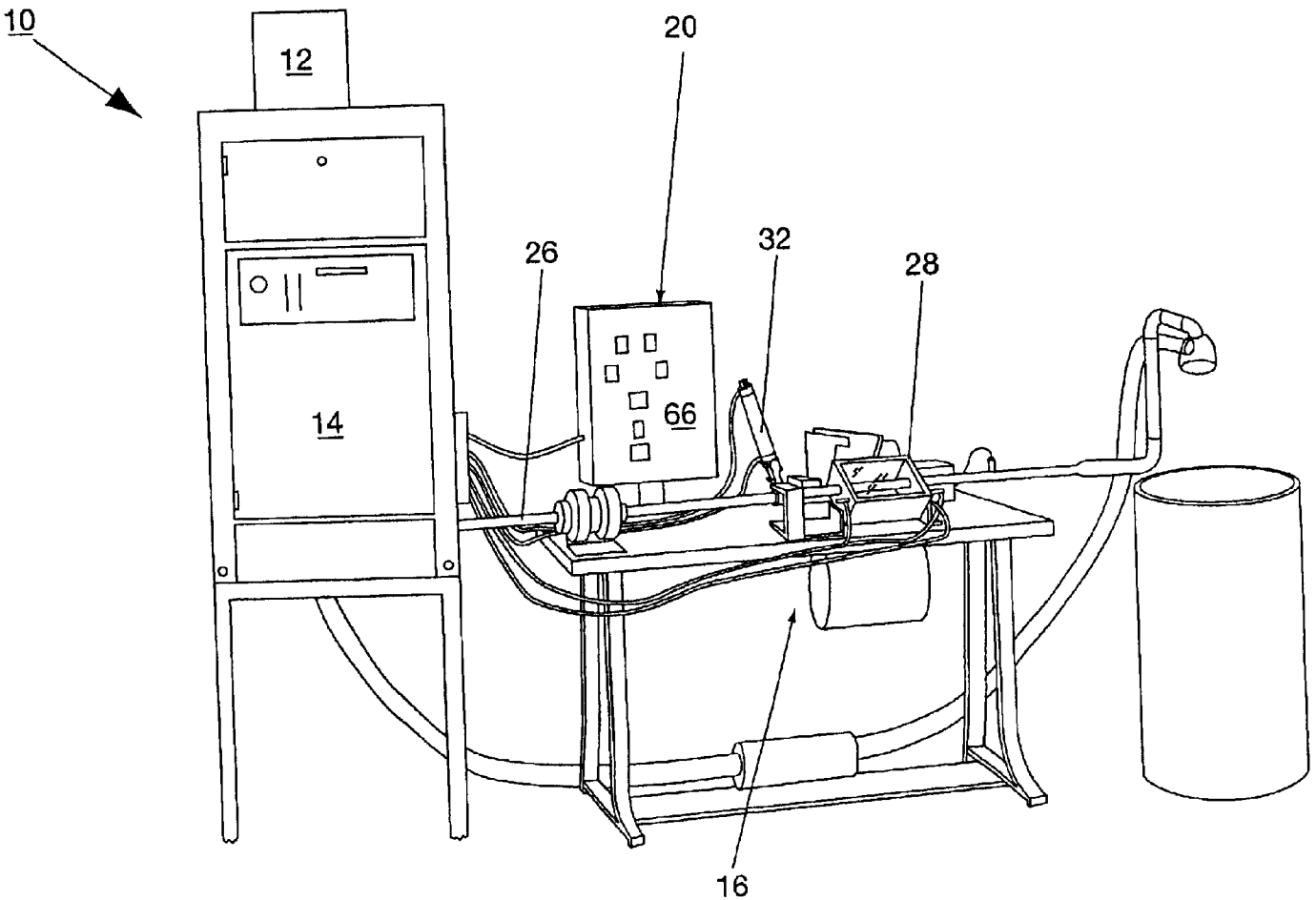
FIG. 1 illustrates a front elevational view of the circular knitting machine for producing tubular knitted products constructed according to the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to drawings in general and FIG. 1 in particular, it will be understood that the illustrations are for the purpose of describing a preferred embodiment of the invention and are not intended to limit the invention thereto. As best seen in FIG. 1, a circular knitting machine for producing a tubular article having a closed end indicated generally by the numeral 10 is shown constructed according to the present invention.

In the preferred embodiment, the circular knitting machine 10 includes a knitting cylinder 12 and an accumulator 14 downward of the knitting cylinder 12. The circular knitting machine 10 may include yarn supply upstream from the circular knitting element 12. Also, the circular knitting machine 10 may include a stitching closure assembly 16 downstream from and joined by conduit 26 to accumulator 14. The stitching closure assembly 16 includes a sewing head 22 and a fabric positioner 24. The circular knitting machine 10 produces a tubular knit article.

Figure 2:
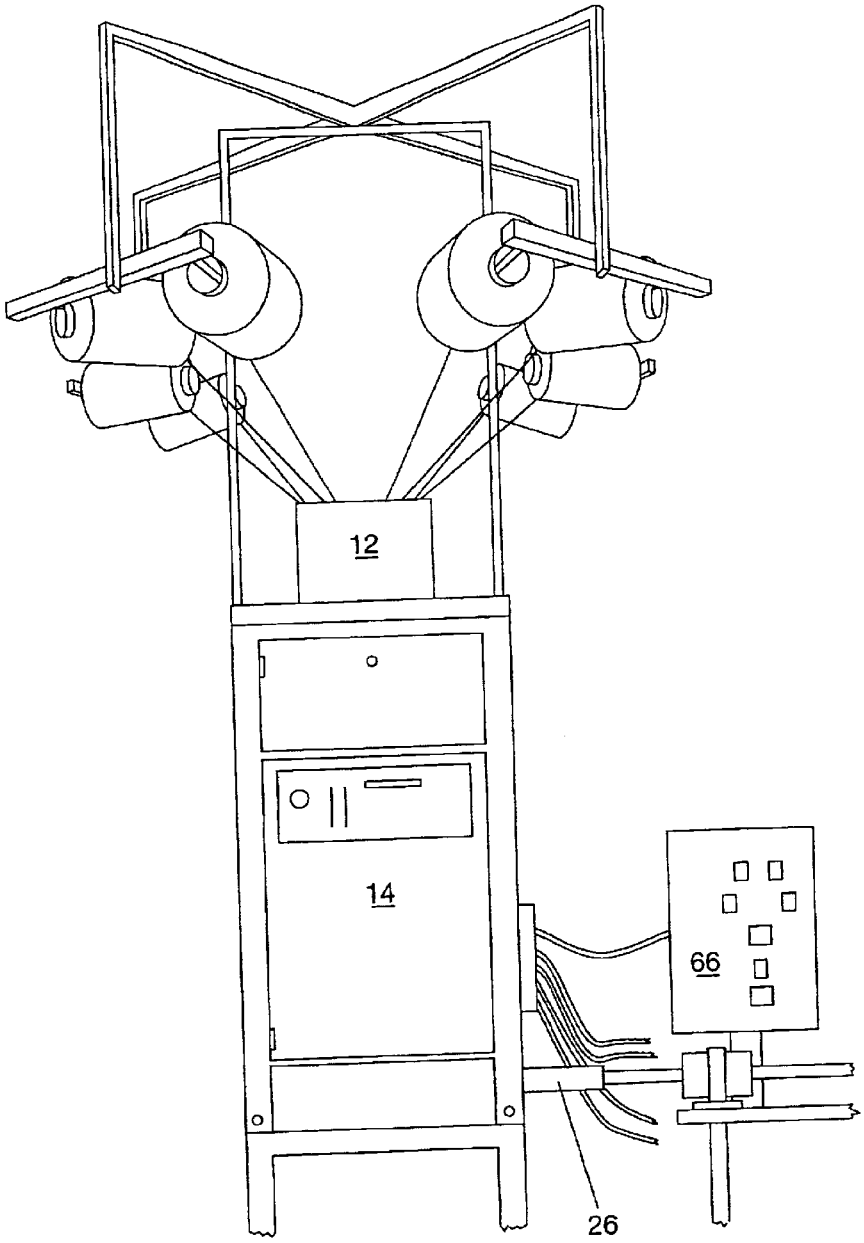
FIG. 2 illustrates a front enlarged view of the accumulator assembly of the circular knitting machine; it also reflects the controller for clamp activation.
Figure 3:
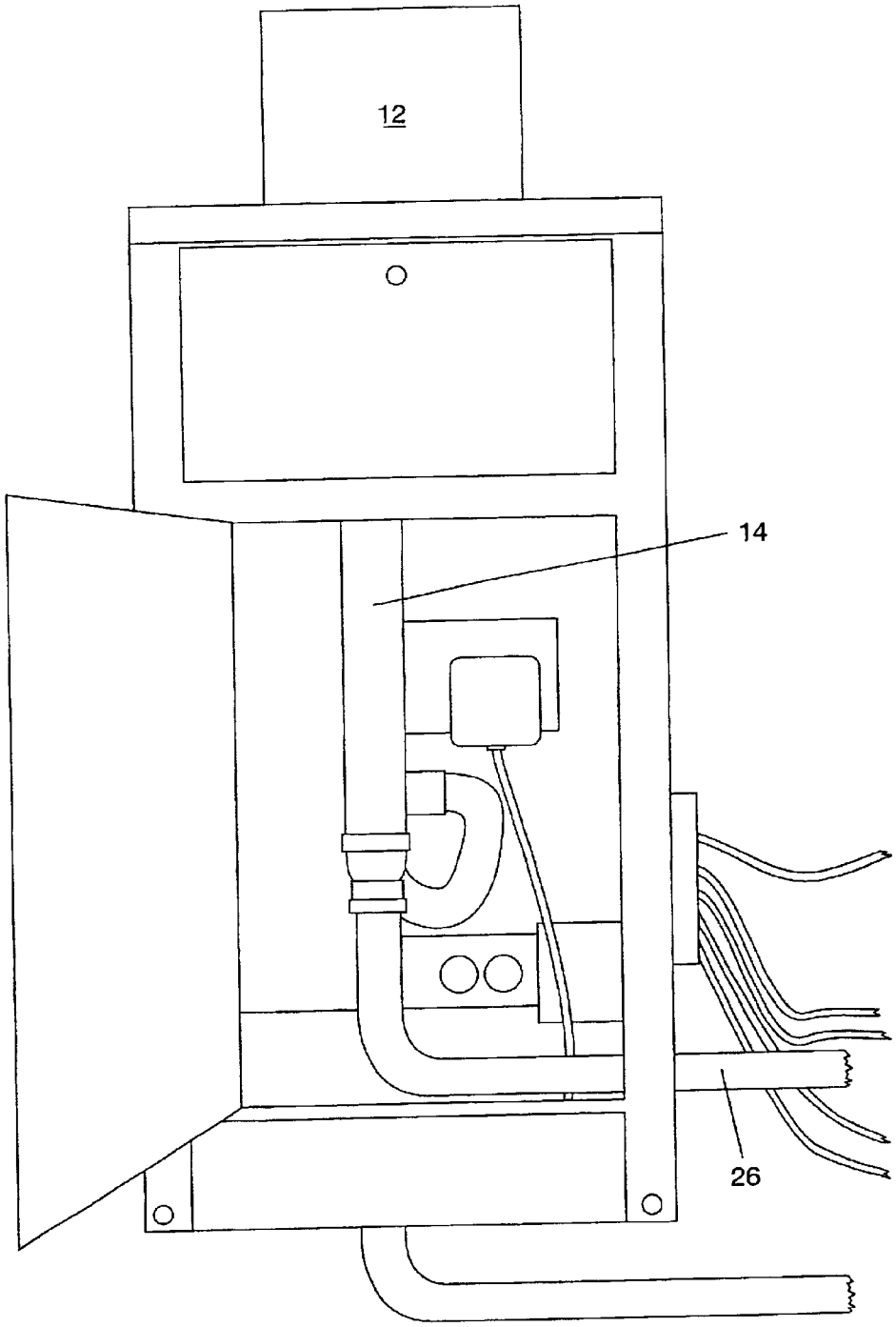
FIG. 3 illustrates an enlarged view of the vacuum source arrangement of the circular knitting machine.

FIG. 2 illustrates an enlarged view of the yarn supply upstream from the circular knitting element 12, the accumulator 14, which is downstream from the knitting cylinder 12, and the conduit 26. In FIG. 3, there is an enlarged view with the cover of the accumulator 14 opened that shows some of its specifics. The structure and operation of the accumulator 14 is more fully described in U.S. Pat. No. 5,931,024, the subject matter of which is here by incorporated by reference herein in its entirety.

As best seen in FIGS. 4–8, the stitching closure assembly 16, which is downstream from the accumulator 14, contains a sewing head 22 and the fabric positioner 24 that may be a transfer box. Once formed, the fabric travels under tension to the fabric positioner 24 that is shown as a transfer box including a sealed enclosure 28, a transfer tube 30, and an actuator 32 for rotating the transfer tube 30 to present the fabric to the sewing head 22. The fabric passes through the fabric positioner 24 under tension with a coupling 34, which connects the transfer tube 30 to the conduit 26 and a fabric access port 36 for pulling air in to assist in positioning the fabric in the right position for closure. The fabric is further fed by the fabric feeder 40 in to the sewing head 22. In the preferred embodiment, the fabric feeder 40 is at least one air jet for maintaining tension and keeping the fabric positioned.

Figure 8:
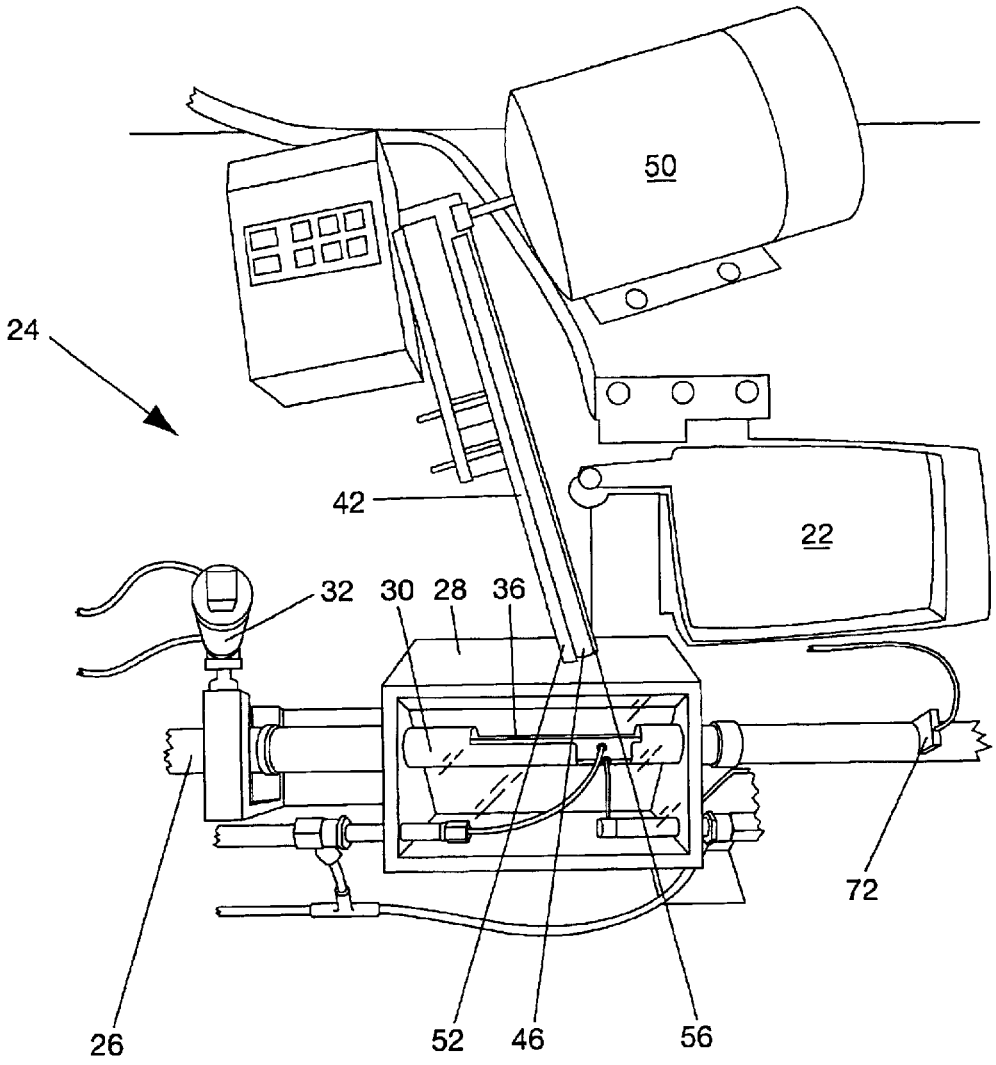
FIG. 8 is a top view of the transfer box, the sewing head, motor and belts making up the fabric guide.
Figure 9:
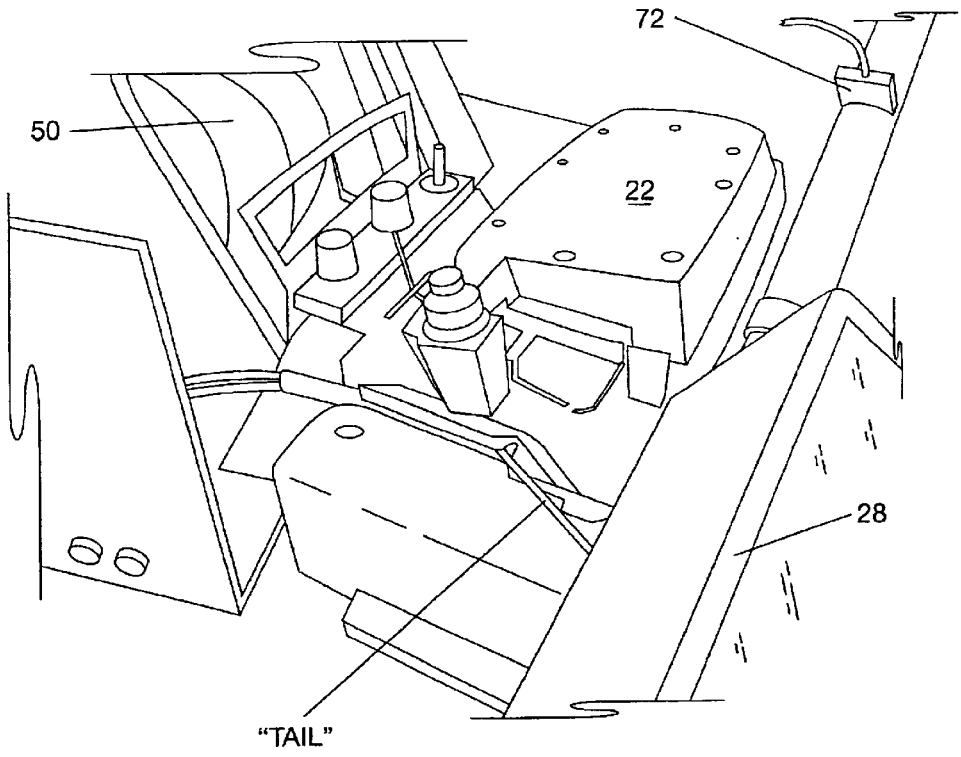
FIG. 9 is a view of the tail formed when the guide is not in place; this tail is the tail of a knitted product.

In the preferred embodiment, the circular knitting machine 10 further includes a fabric guide 42, as shown in FIGS. 4–8. As best seen in FIG. 8, the fabric guide 42 may be an integral part of the stitching closure assembly 16, containing the sewing heads 22 and 24. The fabric guide 42 is composed of frame 44, a belt 46, and motor 50. The function of the fabric guide 42 is to maintain the tension of the fabric as it goes through the transfer tube 30 for presentment when it reaches the appropriate length to be sewn and cut.

Figure 10:
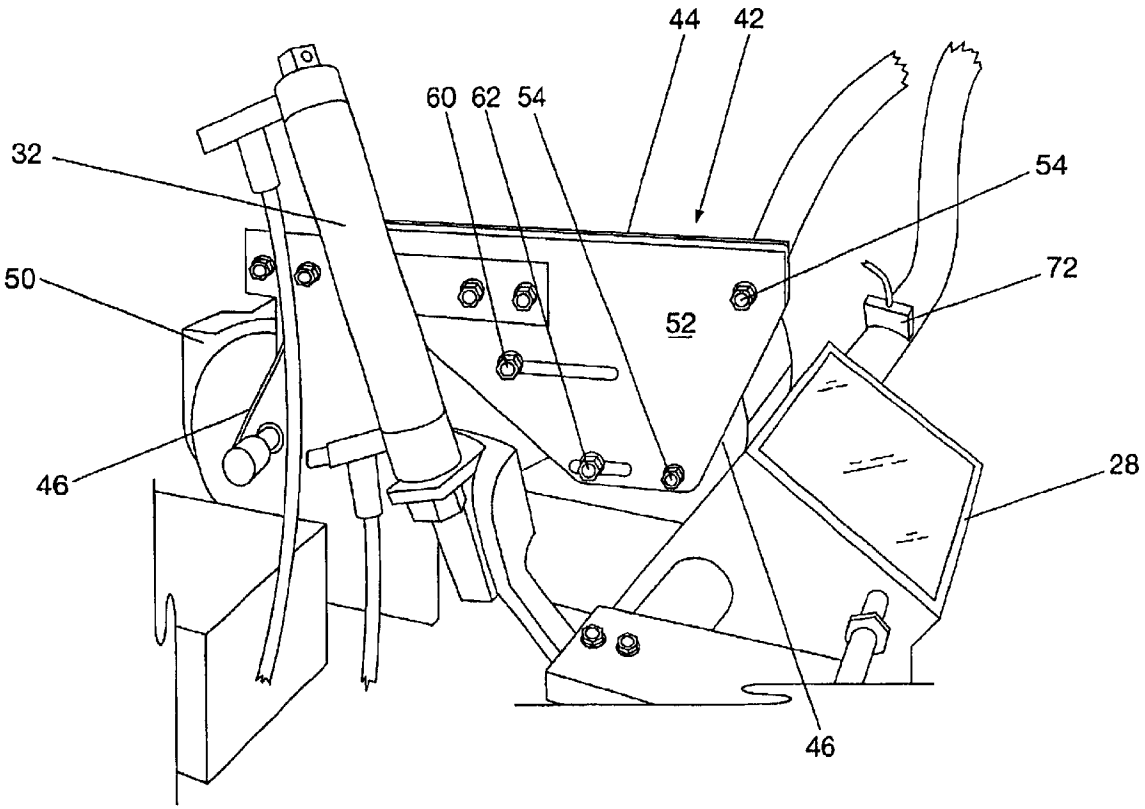
FIG. 10 is an enlarged view of the fabric guide with the frame, belt, motor, transfer box, adjusters and tensioners.

Further as seen in FIG. 10, fabric guide frame 44 may contain a support plate 52 and a plurality of guide rollers 54 for the belt 46. Also, the fabric guide frame 44 may includes belt tensioners 60 and belt length adjuster 62 to ensure that the belt runs smoothly and the length of the material remains constant. The motor 50 may include a speed control device to ensure consitancy.

Figure 4:
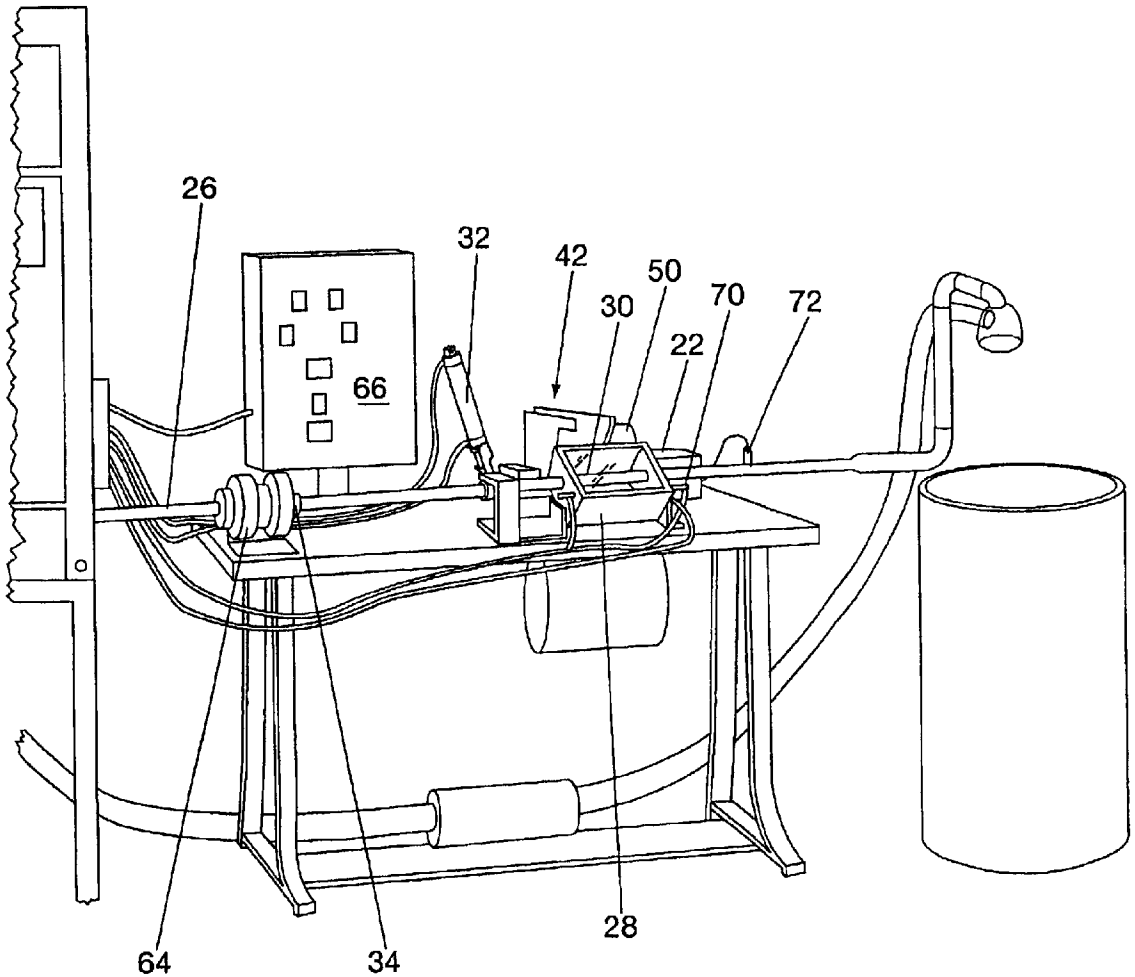
FIG. 4 illustrates an enlarged view of the controller and the transfer box and conduit.
Figure 5:
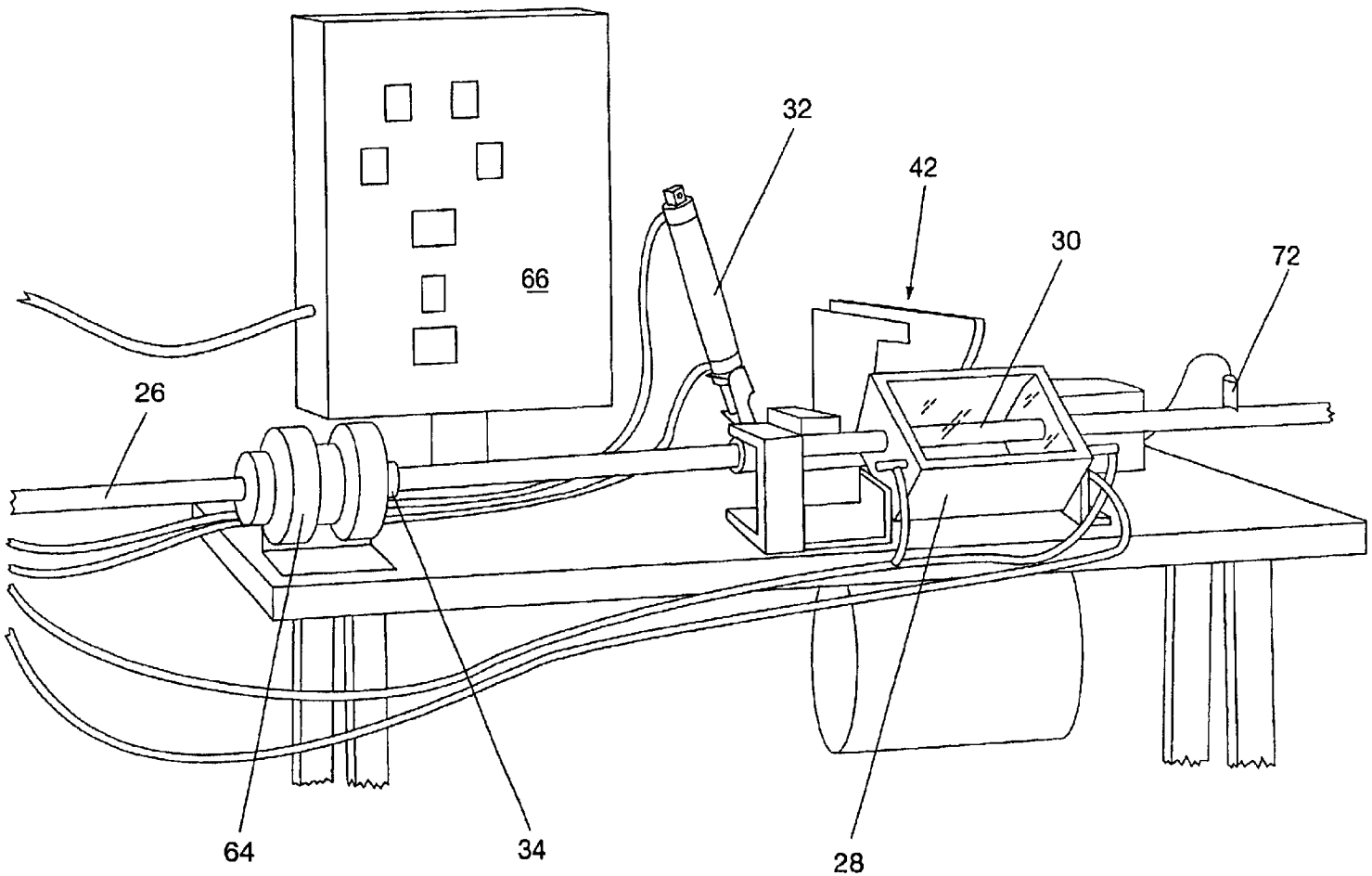
FIG. 5 is an enlarged view of the controller and the transfer box with the actuator and the coupling connecting the transfer tube to the conduit.
Figure 6:
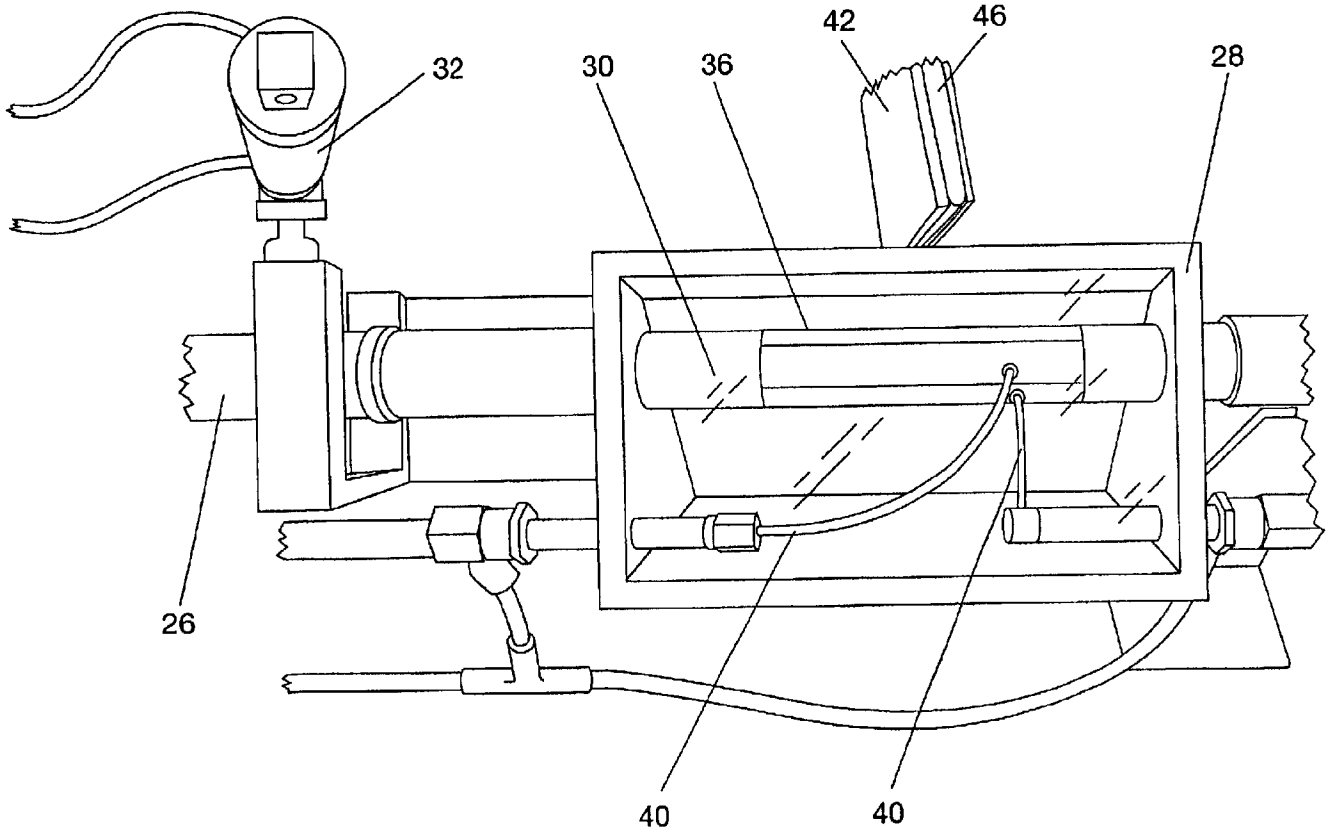
FIG. 6 is an enlarged view of the transfer box.
Figure 7:
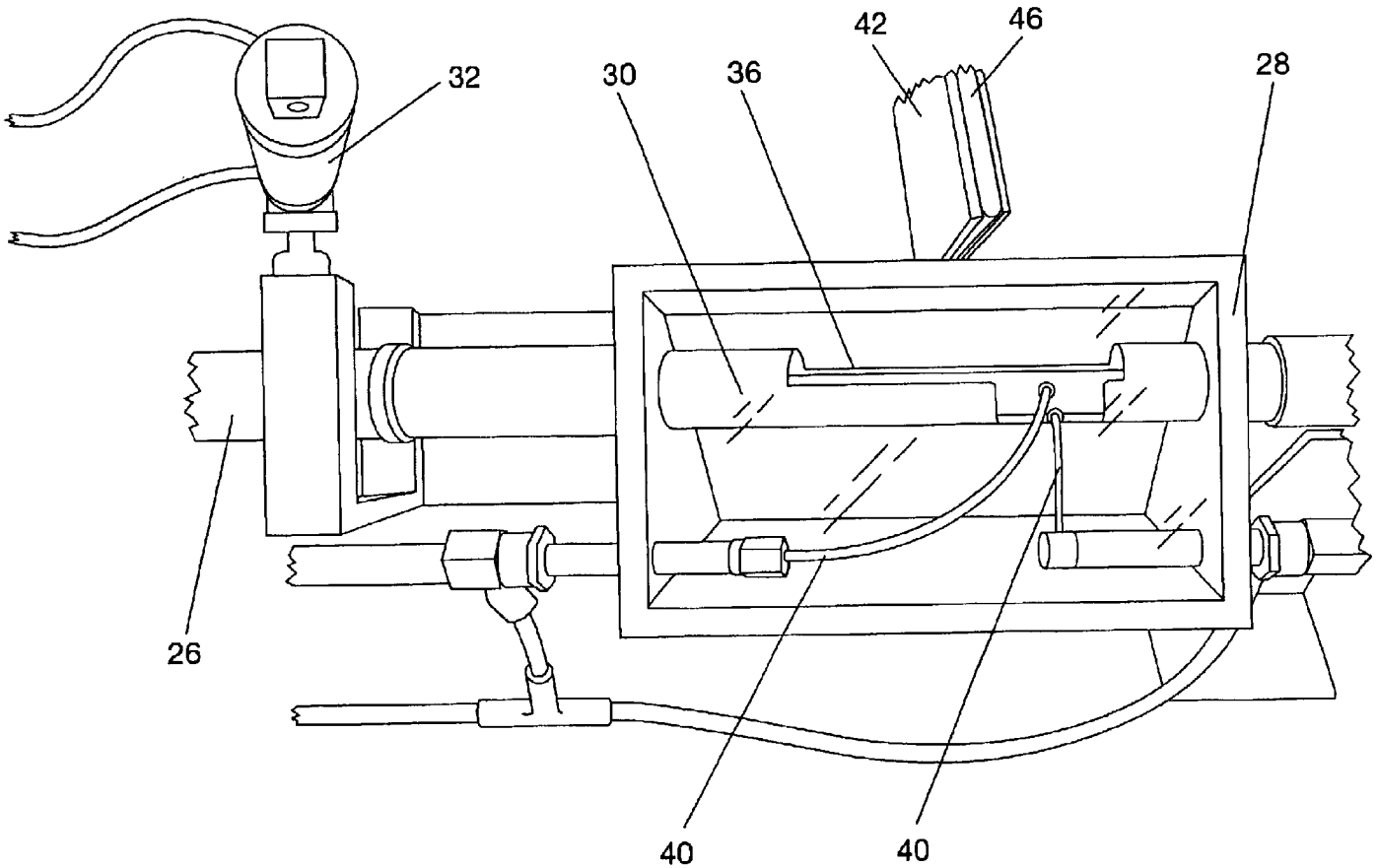
FIG. 7 is an enlarged view of the transfer box in a rotated position.

In the preferred embodiment, the circular knitting machine 10 further includes a fabric control system 20. As best seen in FIG. 4, the fabric control system 20 may include a fabric clamp 64 on the stitch side of the sewing head 22 and a controller 66 for selectively activating the clamp 64. In the preferred embodiment, the fabric clamp 66 is a Buno valve. Further, the fabric control system 20 may include a fabric tensioner 70 on the knife side of the sewing head 22, and a fabric length sensor 72 to indicate when the sewing cycle is to initiate after the fabric is cut to the appropriate length to repeat the cycle.

In operation, the circular knitting machine 10 produces a tubular knit article, which is fed to the accumulator 14, which is downstream from the knitting cylinder 12. The fabric, once formed, travels under tension to the stitching closure assembly 16 that may include a transfer box. Then, the fabric passes through the transfer box under tension with coupling 34, which connects the transfer tube 30 to the conduit 26. The fabric is further fed by the fabric feeder 40 into the sewing head 22, which maintains tension and keeps the fabric positioned.

Fabric guide 42 maintains tension of the fabric as it goes through the access port 36 for presentment to the sewing when it reaches the appropriate length to be sewn and cut. The fabric control system 20 and controller 66 selectively activates the clamp 66. In the preferred embodiment, the fabric clamp 66 is a Buno valve. Fabric tensioner 70 on the knife side of the sewing head 22 maintains fabric tension and fabric length sensor 72 indicates when the sewing cycle is to initiate after the fabric is cut to the appropriate length. The cycle is then repeated.

Certain modifications and improvements will occur to those skilled in the art upon a reading of the foregoing description. By way of example, the fabric guide of the present invention also may be used in other textile manufacturing processes. It should be understood that all such modifications and improvements have been deleted herein for the sake of conciseness and readability but are properly within the scope of the following claims.

I claim:

1. A circular knitting machine for producing a tubular knitted article having a closed end, said apparatus comprising:

(a) a knitting cylinder for forming said tubular knitted material;

(b) an accumulator downstream of said knitting cylinder, said accumulator being selectively operable to permit said knitting cylinder to continuously form said tubular knitted material;

(c) a stitching closure assembly downstream from said accumulator including a sewing head, a fabric positioner and a conduit for connecting said fabric positioner to said accumulator; and (d) a fabric control system including a fabric clamp on the stitch side of said sewing head and a controller for selectively activating said fabric clamp.

2. The circular knitting machine according to claim 1, wherein said fabric clamp is a Buno valve.

3. The circular knitting machine according to claim 1, wherein said fabric control system further includes a fabric tensioner on the knife-side of said sewing head.

4. The circular knitting machine according to claim 3, wherein said fabric tensioner includes an air amplifier.

5. The circular knitting machine according to claim 1, wherein said fabric control system further includes a fabric length sensor for detecting the position of the knitted article and for initiating a new sewing cycle.

6. The circular knitting machine according to claim 1, wherein said fabric positioner is a transfer box.

7. The circular knitting machine according to claim 6 wherein said transfer box includes a sealed enclosure, a rotary transfer tube, and an actuator for rotating the rotary transfer tube to present fabric to said sewing head.

8. The circular knitting machine according to claim 7, wherein said transfer tube includes a coupling to connect said transfer tube to said conduit and a fabric access port.

9. The circular knitting machine according to claim 8, wherein said fabric access port includes an elongated slot.

10. The circular knitting machine according to claim 8, wherein said fabric access port slot is a quarter segment.

11. The circular knitting machine according to claim 8, further including a fabric feeder for presenting the fabric to said sewing head.

12. The circular knitting machine according to claim 11, wherein said fabric feeder includes at least one air jet.

13. A circular knitting machine for producing a tubular knitted article having a closed end, said apparatus comprising:

(a) a knitting cylinder for forming said tubular knitted material;

(b) an accumulator downstream of said knitting cylinder, said accumulator being selectively operable to permit said knitting cylinder to continuously form said tubular knitted material;

(c) a stitching closure assembly downstream from said accumulator including a sewing head, a fabric positioner, a conduit for connecting said fabric positioner to said accumulator and a fabric guide, said fabric guide including: (i) a frame positioned adjacent to said sewing head; (ii) a continuous belt attached to said frame; and (iii) a motor for rotating said belt, whereby said fabric guide maintains tension on the fabric for presentment to said sewing head as the fabric is sewn and cut; and (d) a fabric control system for selectively actuating said sewing head, said fabric positioner and said fabric guide for automatically producing said tubular knitted article having a closed end.

14. The circular knitting machine according to claim 13, wherein said control system includes a fabric clamp on the stitch side of said sewing head and a controller for selectively activating said fabric clamp.

15. The circular knitting machine according to claim 14, wherein said fabric clamp is a Buno valve.

16. The circular knitting machine according to claim 14, wherein said fabric control system further includes a fabric tensioner on the knife-side of said sewing head.

17. The circular knitting machine according to claim 16, wherein said fabric tensioner includes an air amplifier.

18. The circular knitting machine according to claim 14, wherein said fabric control system further includes a fabric length sensor for detecting the position of the knitted article and for initiating a new sewing cycle.

19. The circular knitting machine according to claim 13, wherein said fabric positioner is a transfer box.

20. The circular knitting machine according to claim 19, wherein said transfer box includes a sealed enclosure, a rotary transfer tube, and an actuator for rotating the rotary transfer tube to present fabric to said sewing head.

21. The circular knitting machine according to claim 20, wherein said transfer tube includes a coupling to connect said transfer tube to said conduit and a fabric access port.

22. The circular knitting machine according to claim 21, wherein said fabric access port includes an elongated slot.

23. The circular knitting machine according to claim 21, wherein said fabric access port slot is a quarter segment.

24. The circular knitting machine according to claim 21, further including a fabric feeder for presenting the fabric to said sewing head.

25. The circular knitting machine according to claim 24, wherein said fabric feeder includes at least one air jet.

26. The circular knitting machine according to claim 13, wherein said fame includes a support plate and a plurality of guide rollers for said belt.

27. The circular knitting machine according to claim 13, where said support plate further includes a cover plate.

28. The circular knitting machine according to claim 13, wherein said motor includes a speed control.

29. The circular knitting machine according to claim 13, wherein said fabric guide further includes belt tensioners.

30. The circular knitting machine according to claim 13, wherein said fabric guide further includes belt length adjusters.

* * * * *

UNITED STATES PATENT AND TRADEMARK OFFICE

CERTIFICATE OF CORRECTION

PATENT NO. : 6,848,280 B1
DATED : February 1, 2005
INVENTOR(S) : Larry W. Honeycutt It is certified that error appears in the above-identified patent and that said Letters Patent is hereby corrected as shown below:

Column 2,
Line 29, the "A" after the word "fabric" should be deleted.

Signed and Sealed this

Twenty-fourth Day of May, 2005

JON W. DUDAS
*Director of the United States Patent and Trademark Office*